US005165593A

United States Patent [19]

Chuang

[11] Patent Number: 5,165,593

[45] Date of Patent: Nov. 24, 1992

[54] PACKING BOX WITH A UNITARY, RESEALABLE CAP

[76] Inventor: Emily Chuang, No. 10-3, Alley 3, Lane 47, Sec. 2, Syh-Chuan Rd., Baan-Chyau City, Taipei Hsien, Taiwan

[21] Appl. No.: 839,818

[22] Filed: Feb. 21, 1992

[51] Int. Cl.[5] ..... B65D 5/08

[52] U.S. Cl. ..... 229/129

[58] Field of Search ..... 229/129, 130, 138, 155

[56] References Cited

U.S. PATENT DOCUMENTS

| | | | |
|---|---|---|---|
| 2,670,127 | 2/1954 | Gleason et al. | 229/138 |
| 3,107,042 | 10/1963 | Keith | 229/129 |
| 3,237,840 | 3/1966 | Keith | 229/129 |
| 3,254,825 | 6/1966 | Nolen | 229/129 |
| 3,254,826 | 6/1966 | Keith | 229/129 |
| 3,371,844 | 3/1968 | Perrella | 229/129 |
| 3,549,081 | 12/1970 | Nelson | 229/138 |
| 3,556,385 | 1/1971 | Kato | 229/129 |
| 3,780,932 | 12/1973 | McLaren et al. | 229/129 |
| 3,973,724 | 8/1976 | Stone | 229/129 |
| 4,032,062 | 6/1977 | Kawai et al. | 229/129 |
| 4,795,081 | 1/1989 | Miller | 229/129 |
| 4,930,680 | 6/1990 | Hanus | 229/138 |

*Primary Examiner*—Stephen Marcus
*Assistant Examiner*—Christopher McDonald
*Attorney, Agent, or Firm*—Ostrolenk, Faber, Gerb & Soffen

[57] ABSTRACT

A packing box made by folding a sheet material, and comprised of a body portion, a bottom portion at one end, and a cap portion at an opposite end, said cap portion being folded into four cap panels and four end panels, said end panels being folded up outwards and overlapped on said cap panels respectively, said cap panels being cut into four blocking panels, wherein twisting said cap panels and end panels downwards in one direction causes said blocking panels to be intersected and overlapped one another in blocking up the top opening of the packing box; twisting said cap panels and end panels upwards in an opposite direction causes said blocking panels to be separated from one another permitting said top opening to be opened.

4 Claims, 5 Drawing Sheets

PACKING BOX WITH A UNITARY, RESEALABLE CAP

BACKGROUND OF THE INVENTION

The present invention relates to packing boxes. More particularly, the present invention relates to a packing box made of a sheet of paper and having a unitary, resealable cap that opens when pulled or closes when pressed.

A packing box which is to be used in packing medicines or small products, is generally made of a sheet of paper through the process of folding and cutting with end strips formed at two opposite ends for closing. The end strips at either end are overlaid one another and retained into shape so as to close the two opposite ends of the box. This structure of packing box is easy to produce, however, when the box can not be sealed again when opened.

SUMMARY OF THE INVENTION

The present invention has been accomplished to eliminate the aforesaid problem. It is therefore an object of the present invention to provide a packing box which is made by folding up a single sheet of paper. It is another object of the present invention to provide a packing box which has a cap portion around the top opening thereof that can be closed to seal the packing box again when opened.

DETAILED DESCRIPTION OF THE PREFERRED EMBODIMENT

Figure 1:
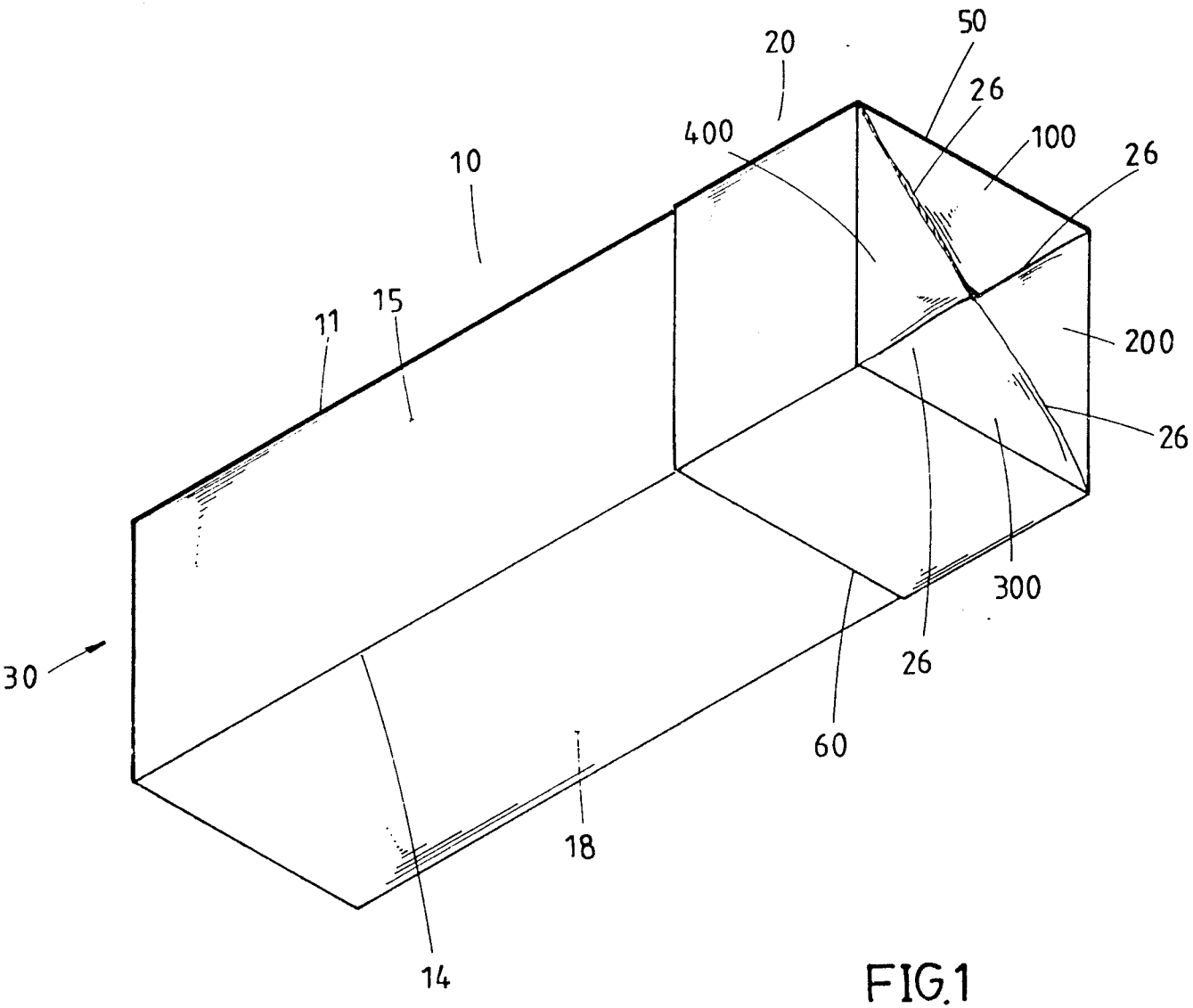
FIG. 1 is a perspective view of the preferred embodiment of the packing box of the present invention.

Referring to FIG. 1, a packing box is made from a single sheet of paper and comprised of a body portion 10, a cap portion 20 at one end, and a bottom portion 30 at an opposite end.

Figure 2:
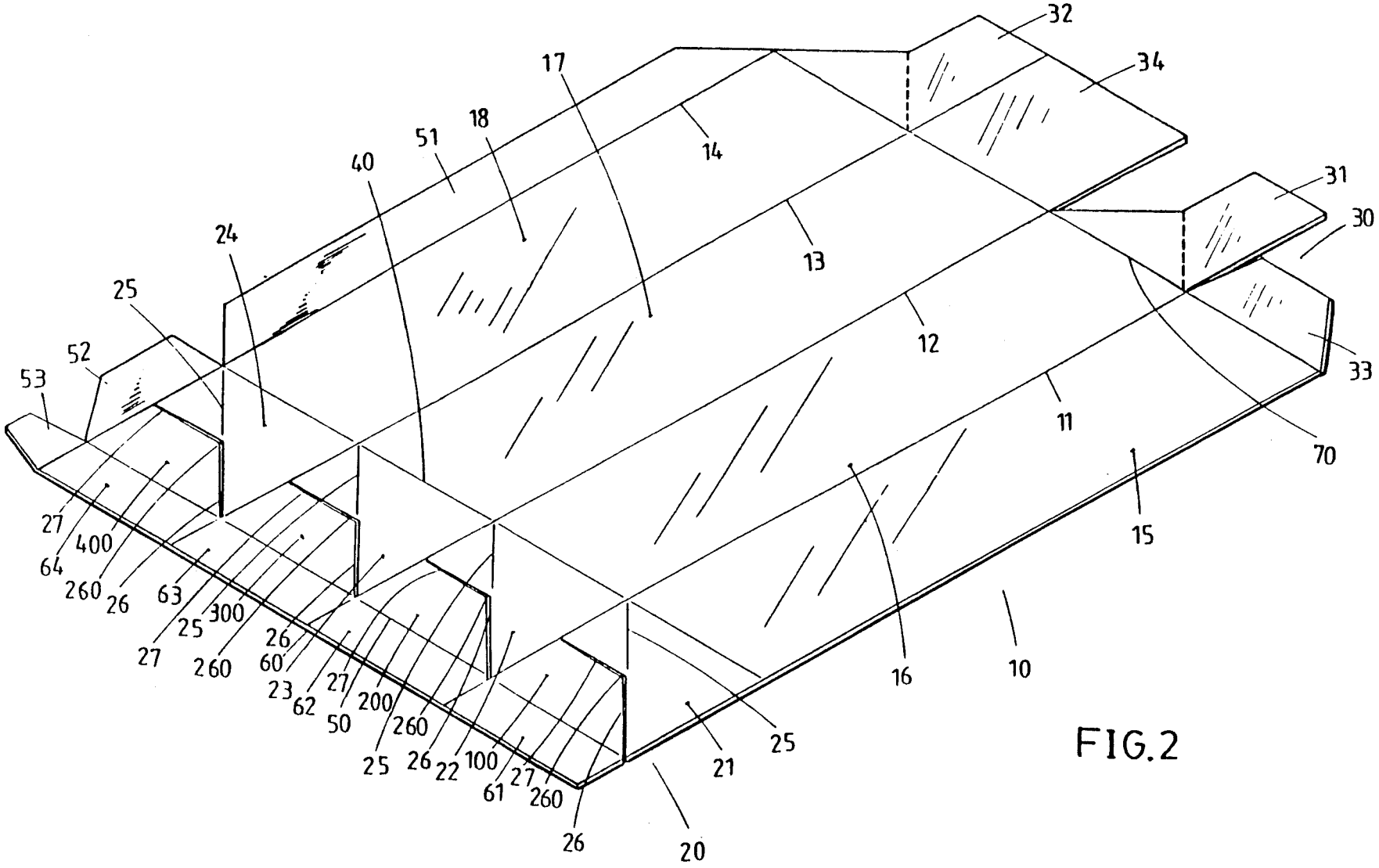
FIG. 2 is a spread-out view thereof.

Referring to the spread-out view of the packing box as shown in FIG. 2, four parallel fording lines, namely, a first folding line 11, a second folding line 12, a third folding line 13 and a fourth folding line 14 are formed on the sheet of paper longitudinally, defining the body portion 10 into a first body panel 15, a second body panel 16, a third body panel 17, a fourth body panel 18 and a first side panel 51. The four body panels 11, 12, 13, 14 are equal in size and form the four sides of the packing box. A fifth folding line is transversely formed between the body portion 10 and the cap portion 20. A six folding line 50 is transversely made on the cap portion 20 spaced from the fifth folding line 40. A seventh folding line 70 is transversely formed between the body portion 10 and the bottom portion 20. The cap portion 20 is divided by the following lines 11, 12, 13, 14, 50 into a first cap panel 21, a second cap panel 22, a third cap panel 23, a fourth cap panel 24 and a second side panel 52 transversely aligned between the fifth and six folding lines 40, 50, and a first end panel 61, a second end panel 62, a third end panel 63, a fourth end panel 64 and a third side panel 53. The first, second, third and fourth end panel 61, 62, 63, 64, and the third side panel 53 are transversely connected into an end strip 60. The bottom portion 30 is divided by the folding lines 11, 12, 13, 14 into a first bottom panel 33, a second bottom panel 31, a third bottom panel 34 and a fourth bottom panel 32. The four cap panels 21, 22, 23, 24 each has a diagonal folding line 25 in the same direction, a first cut 26 made on the upper half part of the diagonal folding line 25 and a second cut 27 transversely extended from the bottom end 260 (namely, the center point of the diagonal folding line 25) to the first, second, third or fourth folding line 11, 12, 13 or 14. Four blocking panels, namely, a first blocking panel 100, a second blocking panel 200, a third blocking panel 300 and a fourth blocking panel 400 are defined within the first and second cuts 26, 27 and the folding lines 11, 12, 13, 14, 50.

Figure 3:
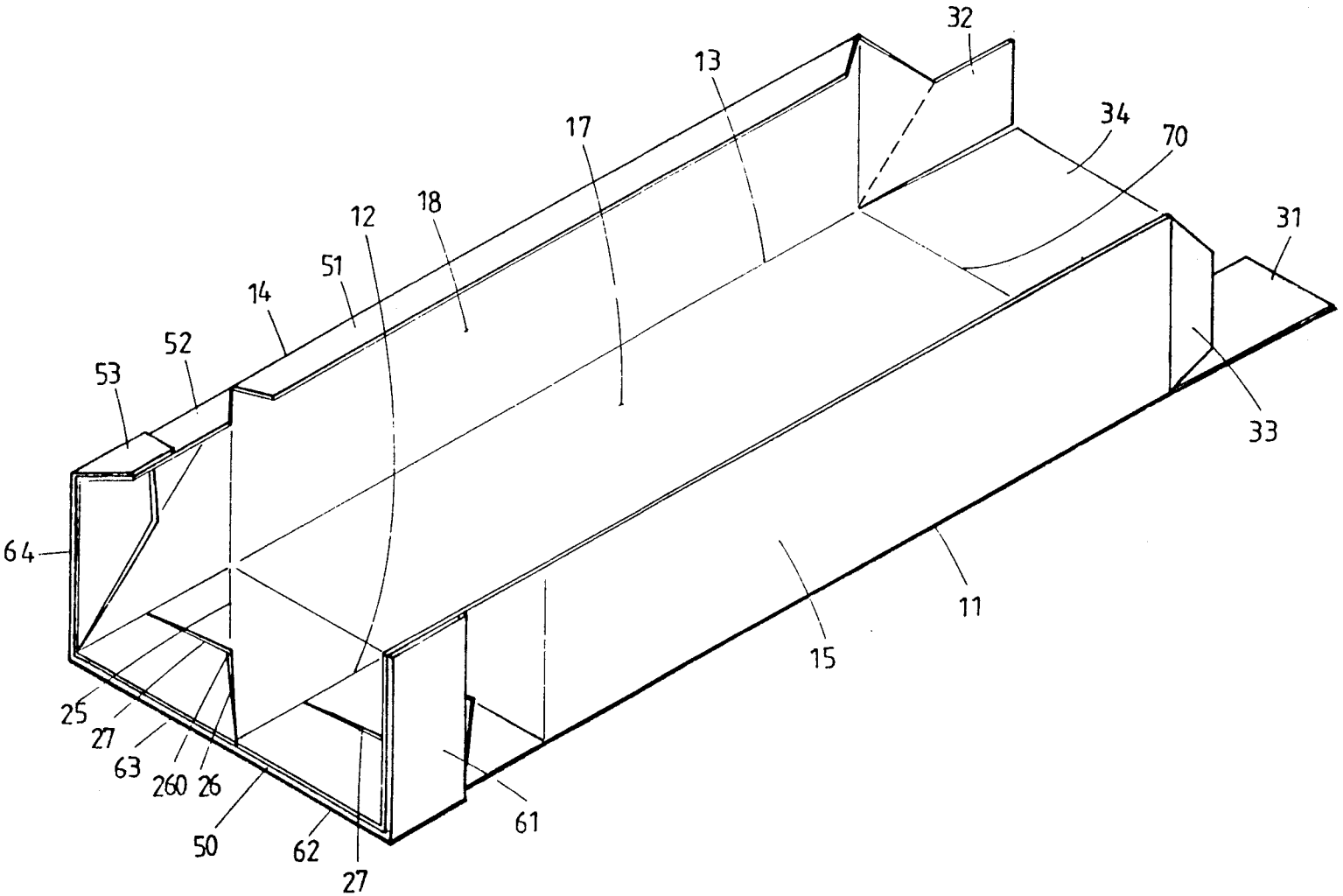
FIG. 3 illustrates that the end strip has been folded up and overlapped on the cap panels.

Referring to FIG. 3, the end strip 60 is folded up outwards, then, the first, second and third side panels 51, 52, 53 are folded up inwards. Then, fold up the sheet of paper along the first, second and third folding lines 11, 12, 13, into a hollow, rectangular column. When the hollow, rectangular column has been formed, fold up the second and fourth bottom panels 31, 32 along the seventh folding line 70, and then, fold up the first and third bottom panels 33, 34. Then, adhere the bottom panels 31, 32, 33, 34 together, and adhere the side panel 51, 52, 53 to the first body panel 15, the first cap panel 21 and the first end panel 61. Therefore, a rectangular box is obtained.

Figure 4:
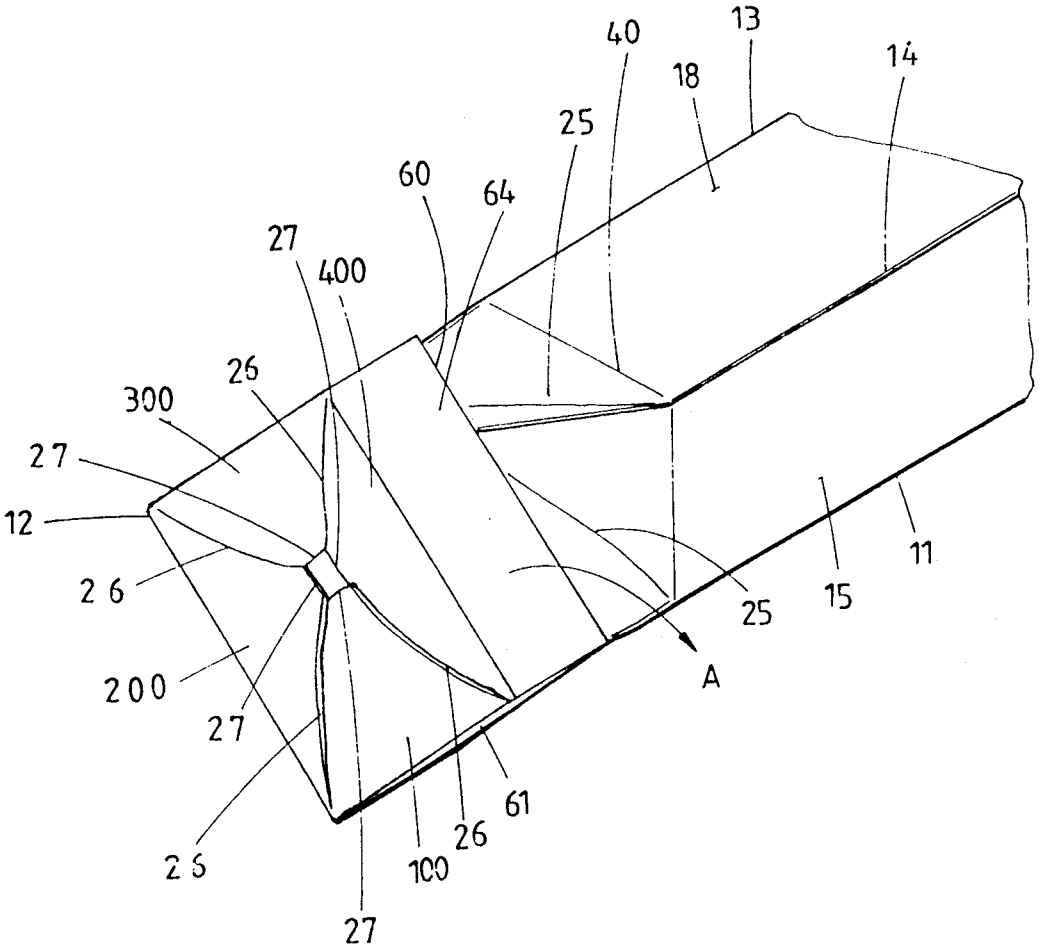
FIG. 4 illustrates that the end panels and cap panels are twisted downwards in one direction to seal the top opening of the packing box.

Referring to FIG. 4, after the formation of the rectangular box, the end strip 60 is twisted downwards along direction A, causing the blocking panels 100, 200, 300, 400 and the end panels 61, 62, 63, 64 to separate along the first and second cuts 26, 27. Once the end strip 60 has been twisted through 90° angle, the blocking panels 61, 62, 63, 64 are intersected and overlapped one another forming into a top plane closing over the top end of the packing box (as shown in FIG. 1.)

Figure 5:
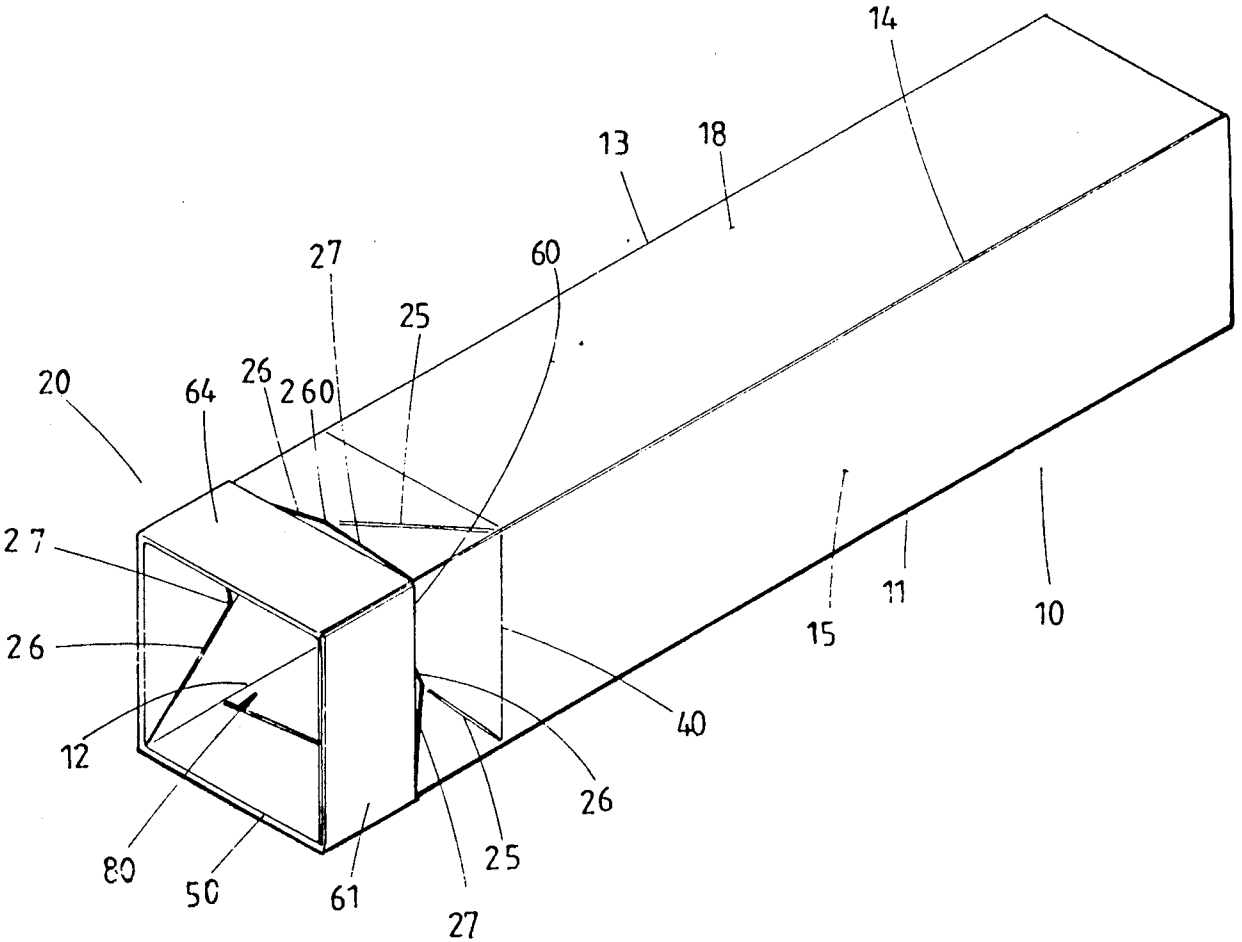
FIG. 5 illustrates that the end panels and cap panels are twisted upwards in an opposite direction to open the top opening of the packing box.

Referring to FIG. 5, the cap portion 20 of the packing box can be conveniently opened by lifting the end strip 60 and twisting it in a direction opposite to the aforesaid direction A. When the packing box is opened, the product contained inside the packing box can be taken out through the top opening 80 defined within the end panel 61, 62, 63, 64.

What is claimed is:

1. A packing box made by folding up a single piece of sheet material, said packing box comprising a body portion for holding things, a bottom portion sealed on said body portion at one end, and a cap portion formed on said body portion at an opposite end to resealably close a top opening thereof; wherein said cap portion comprises four equal cap panels transversely aligned and respectiveliy connected to said body portion, and four end panels transversely aligned and respectively connected to said cap panels, said four end panels being folded up outwards and respectively overlaid on said four cap panels at an outer side, said four cap panels each having a diagonal folding line parallel to one another, a first cut made on an upper half part of said diagonal folding line and a second cut transversely extended from said first cut at one end, said first and second cut being to define a blocking panel on each of said cap panel; and wherein twisting said cap panels and end panels downwards in one direction causes said blocking panels to be intersected and overlapped one another in blocking up said top opening; twisting said cap panels and end panels upwards in an opposite direction causes said blocking panels to be separated from one another permitting said top opening to be opened.

2. The packing box of claim 1, wherein said body portion and said cap portion each has at least one side panel at one side thereof for connecting to an opposite side thereof.

3. The packing box of claim 1, wherein said bottom portion is connected to said body portion by a folding line.

4. The packing box of claim 1, which is formed in a hollow, rectangular column.

* * * * *